US005906252A

United States Patent [19]

Wang

[11] Patent Number: 5,906,252

[45] Date of Patent: May 25, 1999

[54] OIL PRESSURE AUXILIARY ESCAPE DEVICE OF ELEVATOR

[76] Inventor: chiu nan Wang, No. 50, Alley 97, Lane 354, Sanher Road, Fengyuan City, Taichung County, Taiwan

[21] Appl. No.: 08/741,323

[22] Filed: Oct. 29, 1996

[51] Int. Cl.[6] ..... B66B 11/08

[52] U.S. Cl. ..... 187/263; 187/272

[58] Field of Search ..... 187/234, 263, 187/272, 275; 254/89 H, 93 R

[56] References Cited

U.S. PATENT DOCUMENTS 4,592,450 6/1986 Schaffer ..... 187/263

4,830,146 5/1989 Nakamura et al. ..... 187/272

*Primary Examiner*—Kenneth Noland

*Attorney, Agent, or Firm*—Pro-Techtor International

[57] ABSTRACT

An elevator escape device comprises a pressure increasing apparatus and a pressure decreasing apparatus, which are located in the emergency window of an elevator cab and can be operated manually to activate an oil pressure cylinder of the oil pressure mechanism to drive an oil pressure cylinder of the oil pressure mechanism to drive the elevator cab to a desired floor at such time when the elevator cab is diabled by an incident, such as a fire, a power outage, and so forth.

6 Claims, 8 Drawing Sheets

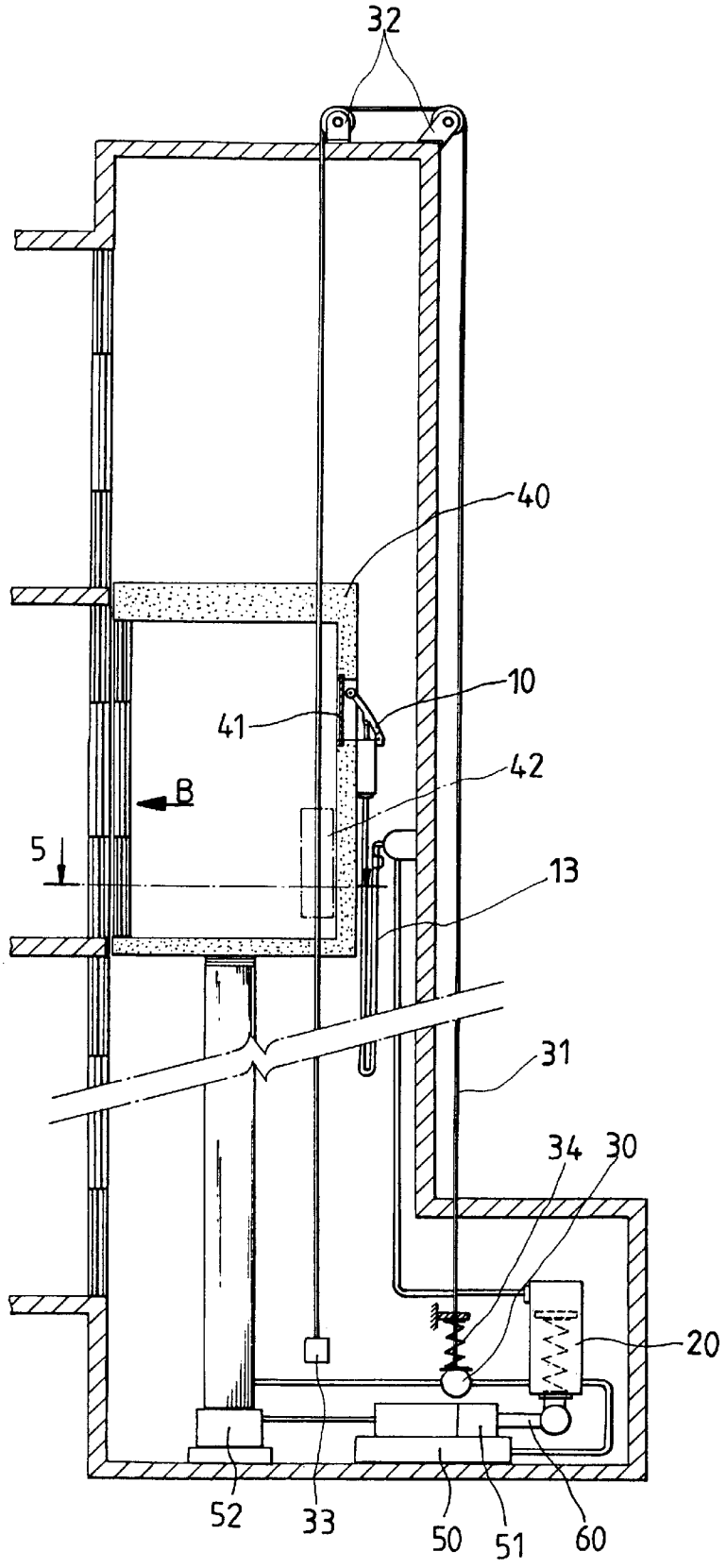
FIG, 2

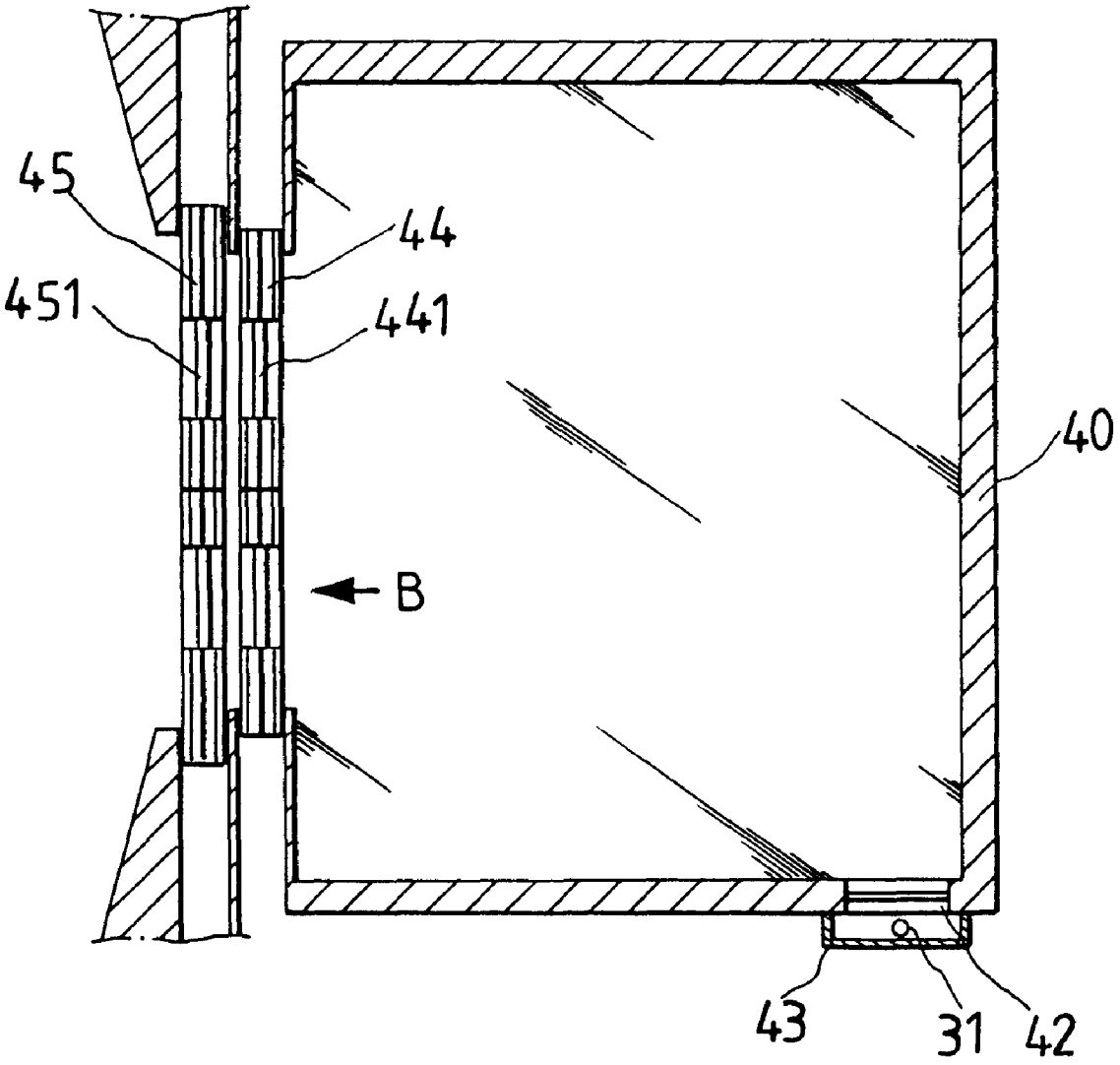
FIG,5

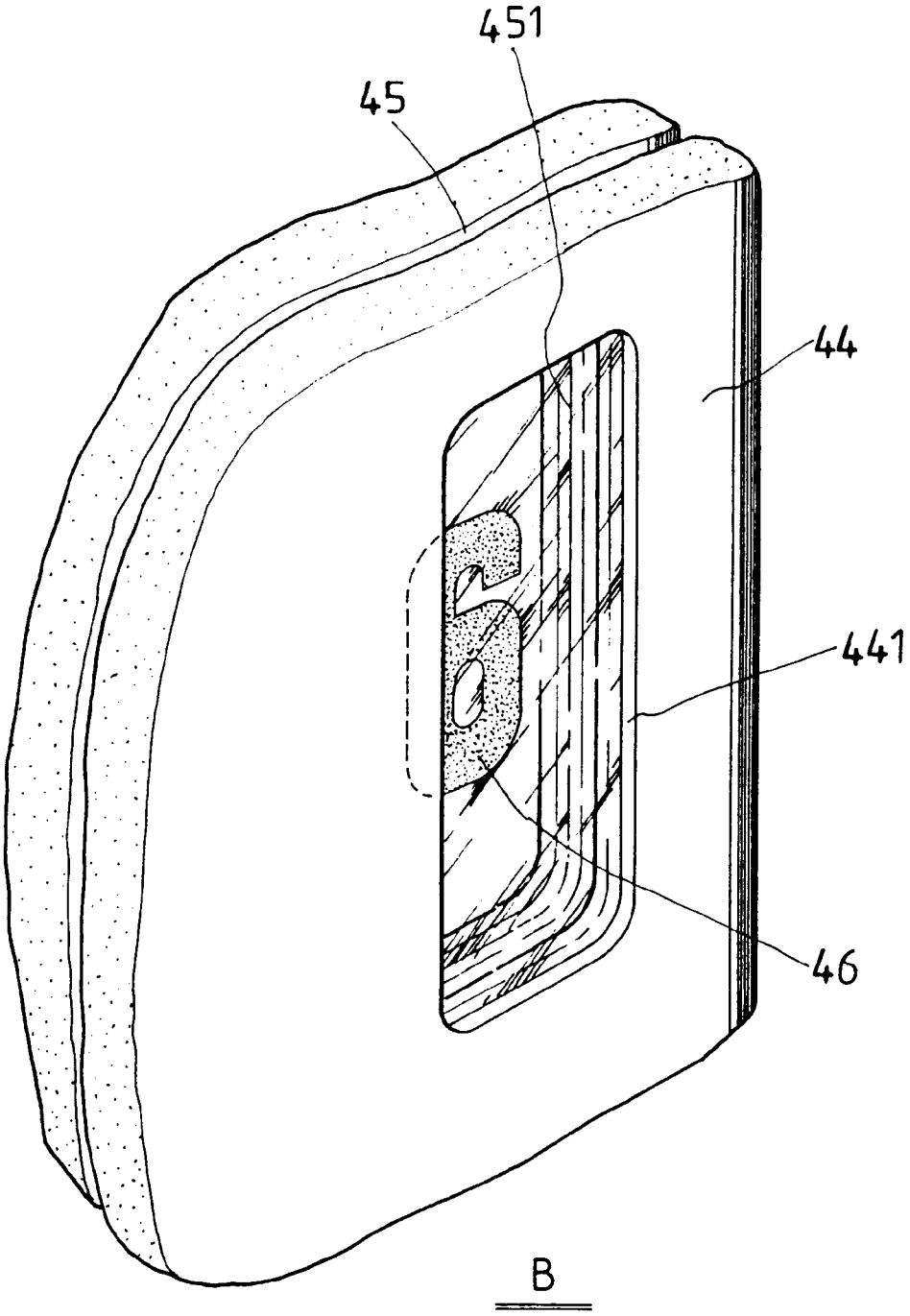
FIG,6

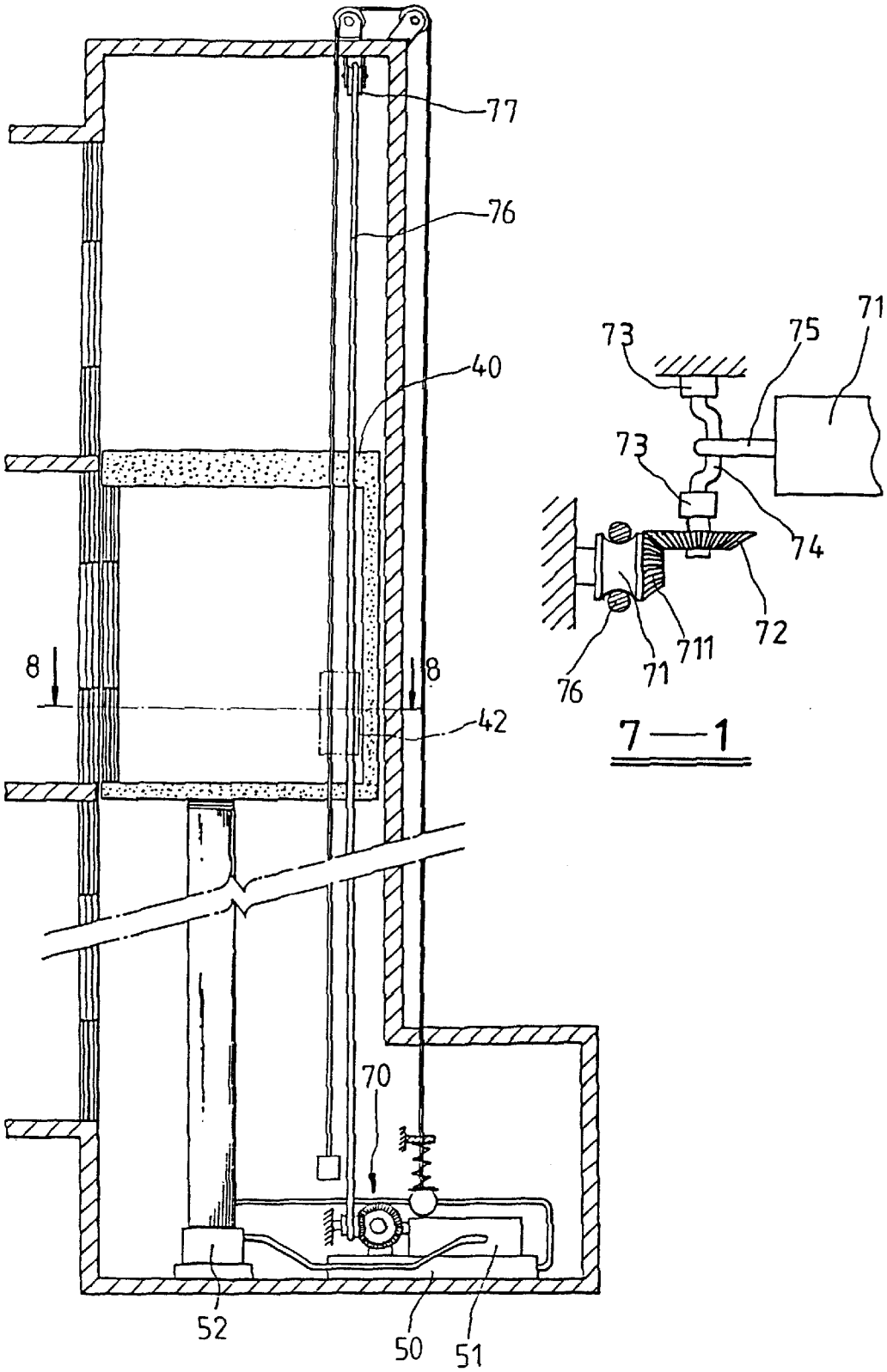
FIG,7

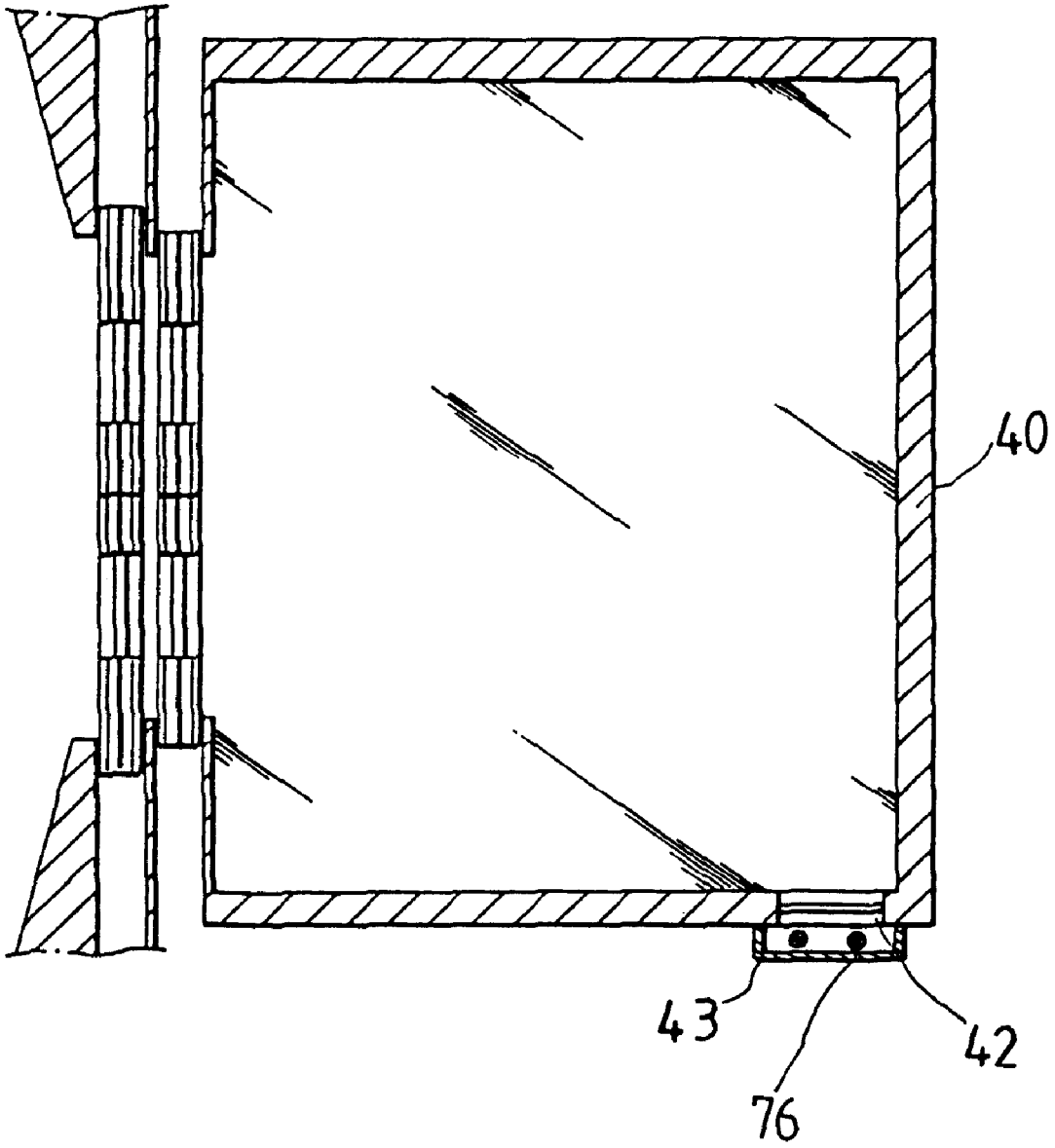
FIG, 8

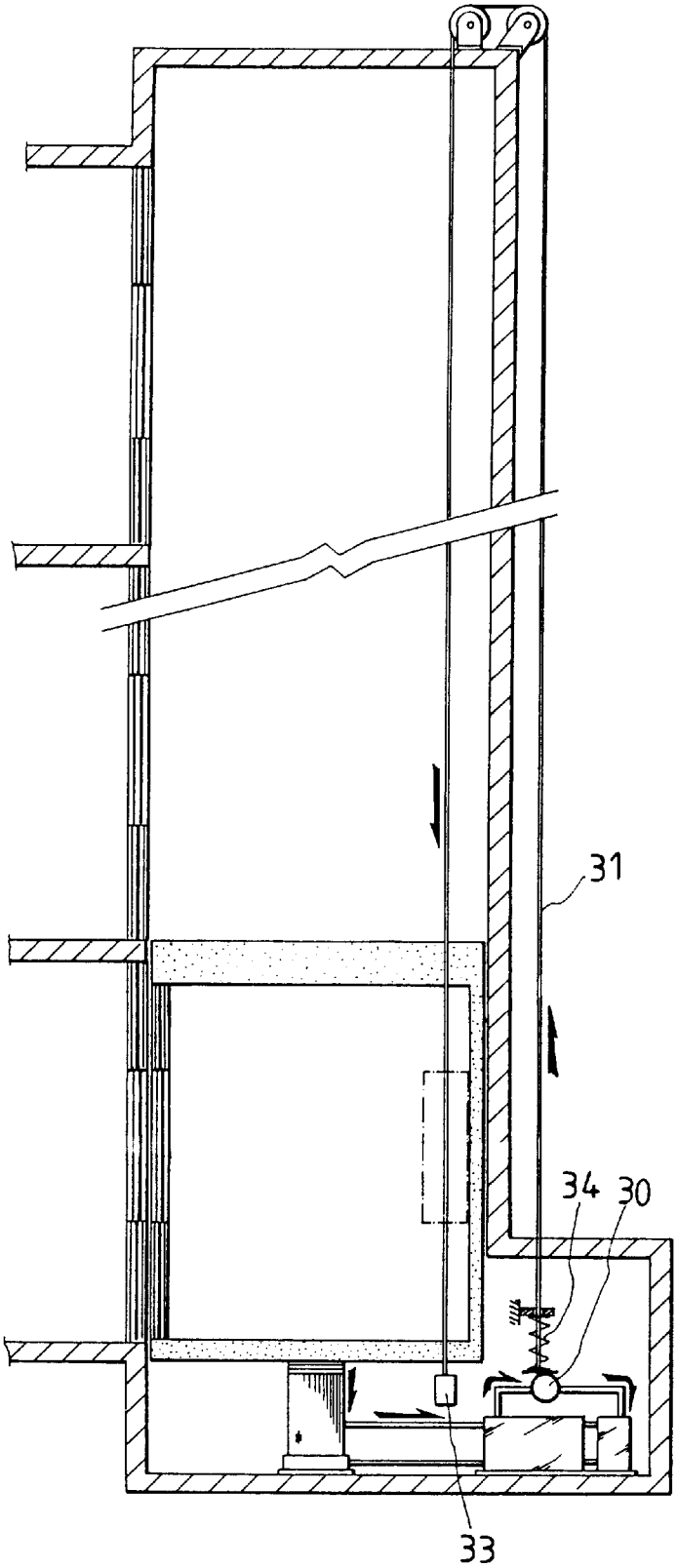
FIG, 9

OIL PRESSURE AUXILIARY ESCAPE DEVICE OF ELEVATOR

FIELD OF THE INVENTION

The present invention relates generally to an elevator, and more particularly to an auxiliary escape device of the elevator.

BACKGROUND OF THE INVENTION

As shown in FIG. 1, an elevator lifting mechanism of the prior art comprises an oil pressure mechanism 1 capable of actuating an oil pressure cylinder 2 to move up and down. The oil pressure cylinder 2 is fastened at one end thereof with an elevator cab 3. The oil pressure mechanism 1 is provided with a pressure lowering valve 4, which is intended for use by a maintenance worker to cause the elevator cab 3 to descent slsowly at such time when the elevator is being serviced or stopped by the power outage.

It is very likely that the elevator cab 3 is stopped right between two floors by an incident or a power interruption. Under such a circumstance, a passenger who is trapped in the elevator cab 3 is often unable to activate the pressure lowering valve 4 to drive the elevator cab 3 to the safety.

SUMMARY OF THE INVENTION

It is therefore the primary objective of the present invention to provide an elevator with an oil pressure auxiliary escape device capable of being operated manually by a trapped passenger to drive the disabled elevator cab upwards or downwards to the safety.

BRIEF DESCRIPTION OF THE DRAWINGS

FIG. 2 shows a schematic plan view of a preferred embodiment of the present invention.

FIG. 5 shows a schematic view of an emergency window of the preferred embodiment of the present invention.

FIG. 6 shows a schematic view of a window of the preferred embodiment of the present invention.

FIG. 7 shows a schematic view of a second preferred embodiment of the present invention.

FIG. 7-1 shows a partial enlarged view of the second preferred embodiment of the present invention.

FIG. 8 shows a schematic view of an emergency window of the second preferred embodiment of the present invention.

FIG. 9 shows a schematic view of a third preferred embodiment of the present invention.

DETAILED DESCRIPTION OF THE EMBODIMENTS

Figure 1:
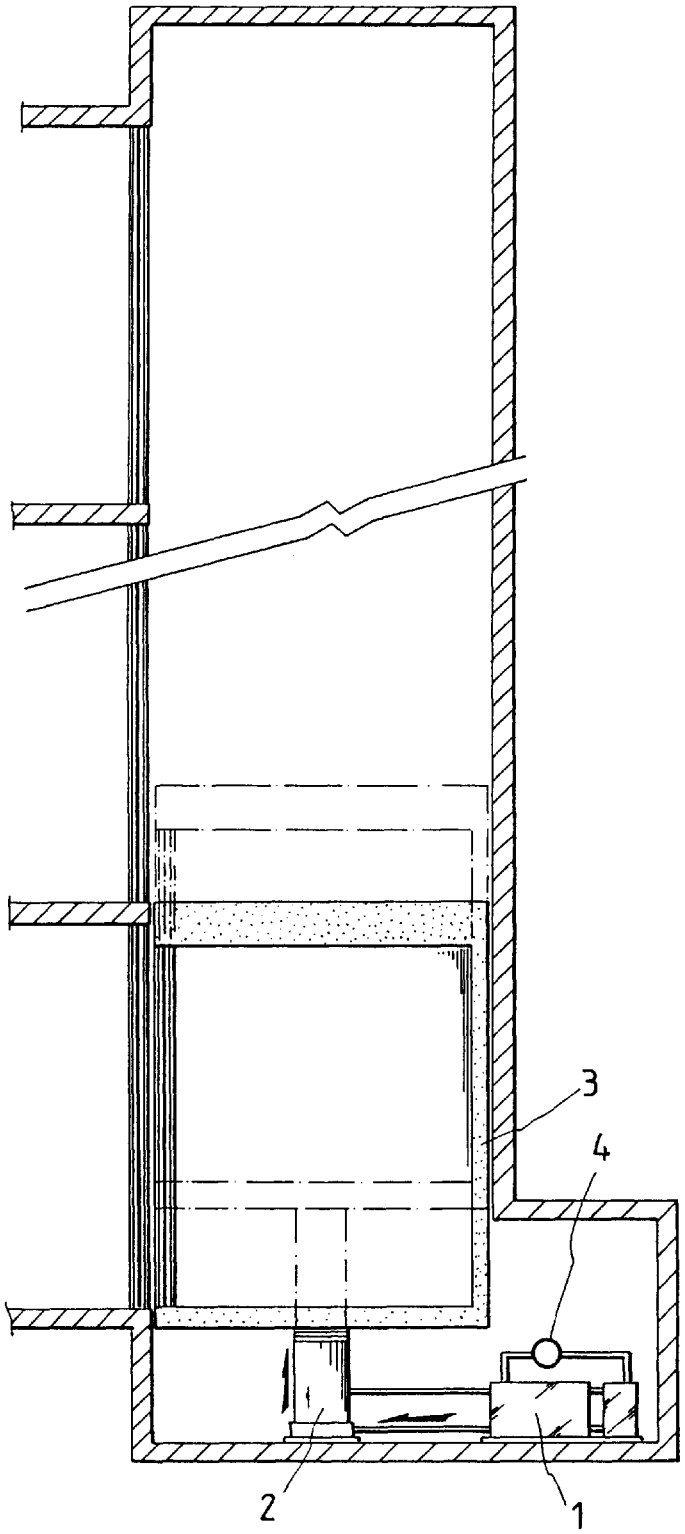
PRIOR ART FIG. 1
FIG. 1 shows a schematic view of an elevator lifting mechanism of the prior art.
Figure 4:
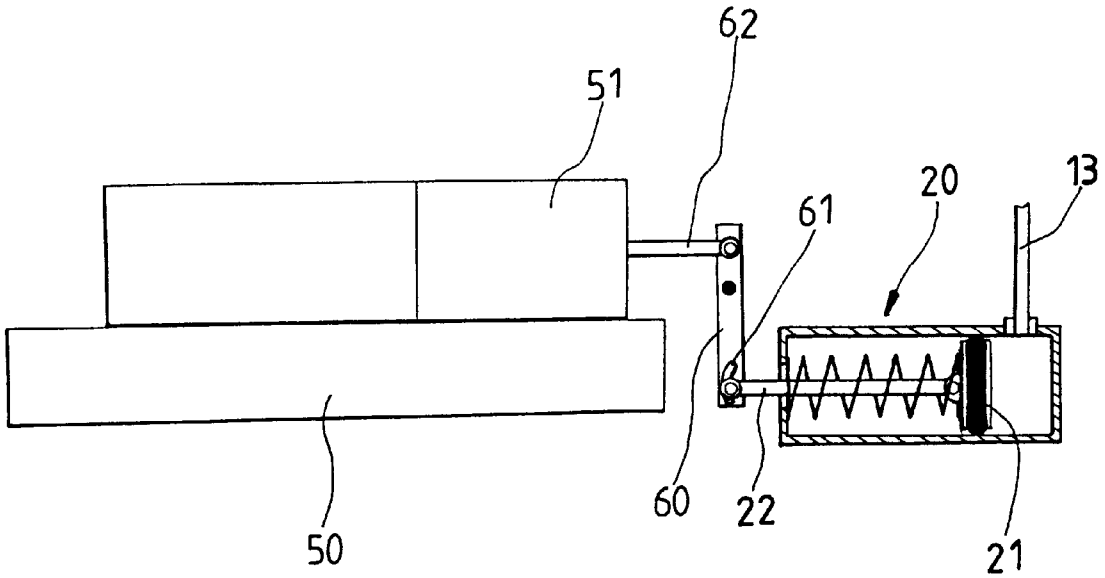
FIG. 4 shows a schematic view of the structure of a pressure increasing valve of the preferred embodiment of the present invention.
Figure 3:
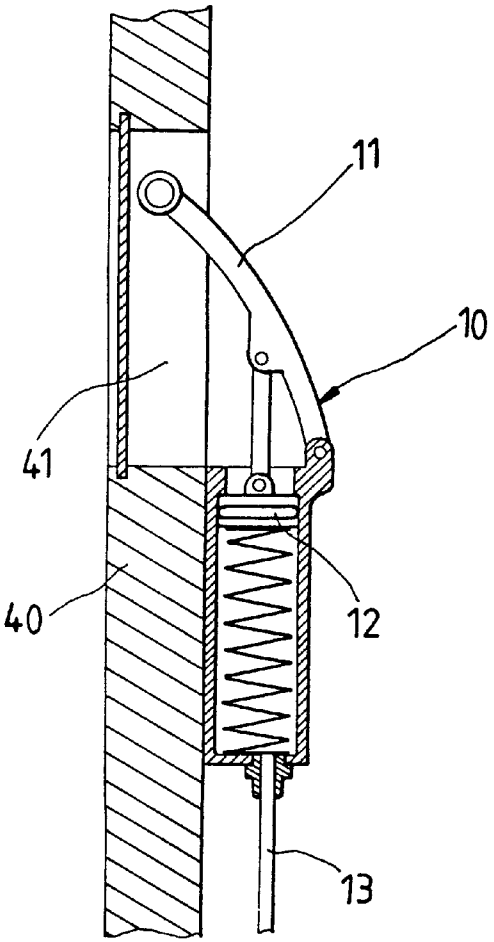
FIG. 3 shows a partial enlarged sectional view of the preferred embodiment of the present invention.

As shown in FIGS. 2–6, an oil pressure auxiliary escape device of elevator of the first preferred embodiment of the present invention is composed of a manually-operated pressure increasing apparatus 10, a pressure increasing valve 20 and a pressure decreasing valve 30.

The pressure increasing apparatus 10 comprises a handle 11 and a piston 12. The apparatus 10 is fastened at one end thereof with an oil pipe 13 and is located in an emergency window 41 of an elevator cab 40.

The pressure increasing valve 20 comprises a piston 21 and a push rod 22. The valve 20 is connected with the oil pipe 13. The push rod 22 is engaged with an arcuate hole 61 of a lever apparatus 60. The lever apparatus 60 is fastened at one end thereof with a link rod 62 of an oil pressure mechanism 51. The length of the oil pipe 13 is dependent on the height of a building in which the elevator is located. The midsegment of the oil pipe 13 is located in the middle of the building.

The pressure decreasing valve 30 has a starting end which is provided with an action cable 31. The action cable 31 is fastened at one end thereof with a rotary wheel 32 located at the top of the elevator shaft, whereas the action cable 31 is fastened at another end thereof with a tension weight 33 located at the bottom of the elevator shaft. The action cable 31 and the pressure decreasing valve 30 are provided there between with a spring 34 for balancing the action cable 31 and weight of tension weight 33 so as to prevent the pressure decreasing valve 30 from being activated at such time when the action cable 31 and the tension weight 33 remain static. The oil contained in the oil pressure cylinder 52 is not released when the pressure decreasing valve 30 is not exerted on by the pull force of the action cable 31, thereby ensuring the descending safety of the elevator cab 40.

The elevator cab 40 is provided therein with an emergency window 42 having a cap 43 through which the action cable 31 is put. The elevator cab 40 is further provided in the inner door 44 thereof with a see-through window 441 which is corresponding in location to another see-through window 451 located in the outer door 45 of each floor. The see-through window 451 is marked with the floor number capable of illuminating at night.

In operation, a passenger trapped in the disabled elevator cab 40 can reach for the handle 11 of the pressure increasing apparatus 10 via the emergency window 41. The handle 11 is pressed steadily to actuate the piston 12 so as to enable the oil of the oil pipe 13 to act on the pressure increasing valve 20. As a result, the piston 21 of the pressure increasing valve 20 is under the pressure of the oil of the oil pipe 13, thereby causing the push rod 22 to act on the oil pressure mechanism 51 via the link rod 62 of the lever apparatus 60. The pressure of the oil pressure cylinder 52 is caused by the oil pressure mechanism 51 to increase. The increase in the pressure in the oil pressure cylinder 52 brings about lifting of the disabled elevator cab 40.

On the other hand, the disabled elevator cab 40 can be caused to descend slowly by actuating the action cable 31 via the emergency window 42 located in the cab 40. As the action cable 31 is pulled manually, the pressure descreasing valve 30 is activated to bring about the release of the oil contained in the oil pressure cylinder 52. The oil so released is then allowed to flow back to the oil tank 50. As a result, the disabled elevator cab 40 is descended slowly. The trapped passenger in the disabled cab 40 is descended slowly. The trapped passenger in the disabled cab 40 can see the floor number 46 via the see-through window 441 so as to stop the elevator cab 40 at a desired floor. As shown in FIG. 6, the floor number 46 is the 6th floor. As soon as the trapped passenger has seen the floor number, he or she should let the action cable 31 go immediately to enable the pressure decreasing valve 30 to stop the release of the oil contained in the oil pressure cylinder 52. As a result, the elevator cab 40 comes to a halt at the 6th floor, as illustrated in FIG. 6.

Now referring to FIGS. 7 and 8, the second preferred embodiment of the present invention comprises a manually-operated pressure increasing apparatus 70, which is located over the oil tank 50. Located over the oil tank 50 is a pulley set 71, which has a sectoral master gear 711 engaging a sectoral slave gear 72. The slave gear 72 is provided at one end thereof with two bearings 73 opposite in located to each other. The slave gear 72 is fastened pivotally with one of the two bearings 73. Located between the two bearings 73 is an eccentric shaft 74, which is provided at the midsegment thereof with a push rod 75 fastened pivotally therewith such that the push rod 75 is fastened at another end thereof with the oil pressure mechanism 51 located over the the oil tank 56. The pulley set 71 is provided with an action cable 71 wound thereon such that the action cable 71 is fastened at one end thereof with the rotary wheel 77 located at the top of the elevator shaft. The elevator cab 40 is provided therein with the emergency window 42. The action cable 76 is put through the cap 43 located outside the elevator cab 40.

In case of emergency, a passenger trapped in the elevator cab 40 can reach for the action cable 76 of the pressure increasing apparatus 70 via the emergency window 42. As the action cable 76 is pulled, the pulley set 71 is actuated to rotate so as to cause the master gear 711 to drive the slave gear 72, which in turn drives the eccentric shaft 74. As the eccentric shaft 74 is actuated, the push rod 75 which is fastened pivotally with the eccentric shaft 74 is activated to act on the oil pressure mechanism 51. As a result, the oil pressure cylinder 52 is caused by the oil pressure mechanism 51 to increase its pressure for lifting the elevator cab 40.

As shown in FIG. 9, the third preferred embodiment of the present invention comprises only the pressure decreasing valve 30 for operating manually the elevator cab 41 in the event of emergency. The third preferred embodiment of the present invention is intended for use in an elevator which is located in a low building.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An elevator auxiliary escape device comprising a manually-operated pressure increasing apparatus and a manually-operated pressure decreasing apparatus, which are located in an emergency window of an elevator cab; wherein said pressure increasing apparatus is composed of a handle and a piston and is fastened at one end thereof with one end of an oil pipe, said oil pipe being fastened at another end thereof with a pressure increasing valve which is linked with one end of an oil pressure mechanism located over an oil tank; and wherein said pressure increasing apparatus and said pressure decreasing apparatus can be operated manually to activate an oil pressure cylinder of said oil pressure mechanism to drive said elevator cab at such time when said elevator cab is disabled by an incident, such as a fire, a power outage, etc.

2. The elevator auxiliary escape device as defined in claim 1, wherein said pressure increasing valve can be replaced with an elastic piston.

3. The elevator auxiliary escape device as defined in claim 1, wherein said pressure increasing valve and said oil pressure mechanism are linked by a lever apparatus such that a push rod of said pressure increasing valve is fastened with one end of said lever apparatus, and that a link rod of said oil pressure mechanism is fastened with another end of said lever apparatus.

4. The elevator auxiliary escape device as defined in claim 1, wherein said pressure increasing apparatus comprises a pulley set having a sectoral master gear, a sectoral slave gear, two bearings, one eccentric shaft, an action cable, and a rotary wheel, said eccentric shaft fastened between said two bearings, with one of said two bearings being fastened pivotally with said slave gear, said eccentric shaft provided at a midsegment thereof with a push rod fastened pivotally therewith such that another end of said push rod is fastened with said oil pressure mechanism, said action cable being wound on said pulley set such that said action cable is fastened at one end thereof with said rotary wheel located at a top of an elevator shaft, and that said action cable is put through a cap located outside said elevator cab.

5. The elevator auxiliary escape device as defined in claim 1, wherein said pressure decreasing apparatus is provided at a starting end thereof with an action cable which is fastened at one end thereof with a rotary wheel located at a top of an elevator shaft and is fastened at another end thereof with a tension weight located at a bottom of said elevator shaft; wherein said action cable and said pressure decreasing apparatus are provided therebetween with a biasing means for balancing the weights of said action cable and said tension weight; and wherein said elevator cab is provided with an emergency window and a cap which can be reached via said emergency window and contains therein said action cable.

6. The elevator auxiliary escape device as defined in claim 1, wherein said elevator cab is provided with a see-through window corresponding in location to an area of an outside wall on a floor of a building in which an elevator shaft is located, with said area being marked with a floor number which can be seen via said see-through window of said elevator cab.

* * * * *